US009099002B2

(12) United States Patent
Lorenz

(10) Patent No.: US 9,099,002 B2
(45) Date of Patent: Aug. 4, 2015

(54) VEHICLE HAVING A DEVICE FOR INFLUENCING THE ATTENTIVENESS OF THE DRIVER AND FOR DETERMINING THE VIEWING DIRECTION OF THE DRIVER

(71) Applicant: Bayerische Motoren Werke Aktiengesellschaft, Munich (DE)

(72) Inventor: Lutz Lorenz, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/228,870

(22) Filed: Mar. 28, 2014

(65) Prior Publication Data

US 2014/0214313 A1 Jul. 31, 2014

Related U.S. Application Data

(63) Continuation of application No. PCT/EP2012/068821, filed on Sep. 25, 2012.

(30) Foreign Application Priority Data

Sep. 30, 2011 (DE) ..... 10 2011 083 833

(51) Int. Cl.
*G08B 21/06* (2006.01)
*G08G 1/16* (2006.01)
*G08B 21/02* (2006.01)

(52) U.S. Cl.
CPC *G08G 1/16* (2013.01); *G08B 21/02* (2013.01); *G08B 21/06* (2013.01)

(58) Field of Classification Search
USPC ..... 701/36, 301; 180/167–170; 340/438, 340/500
See application file for complete search history.

(56) References Cited

U.S. PATENT DOCUMENTS

| | | | | |
|---|---|---|---|---|
| 5,521,580 | A | 5/1996 | Kaneko et al. | |
| 7,202,776 | B2 * | 4/2007 | Breed | 340/435 |
| 8,538,674 | B2 * | 9/2013 | Breuer et al. | 701/301 |
| 2002/0140562 | A1 | 10/2002 | Gutta et al. | |

(Continued)

FOREIGN PATENT DOCUMENTS

| | | | |
|---|---|---|---|
| DE | 43 38 244 | A1 | 5/1994 |
| DE | 10 2008 056 343 | A1 | 5/2010 |

OTHER PUBLICATIONS

International Preliminary Report on Patentability (PCT/IB/326) and (PCT/IB/373) dated Apr. 10, 2014, including Written Opinion (PCT/ISA/237) (nine (9) pages).

(Continued)

*Primary Examiner* — Yonel Beaulieu
(74) *Attorney, Agent, or Firm* — Crowell & Moring LLP

(57) ABSTRACT

A vehicle, in particular a motor vehicle, has a device for influencing the attention of the driver. The vehicle includes a display unit for displaying information content. The vehicle includes a central operating panel associated with the display unit. The vehicle includes a system for detecting a danger in traffic. The vehicle includes a system for issuing a warning regarding a detected danger, and the vehicle further includes a computing unit. The computing unit ascertains a viewing probability of the driver looking in the direction of the display unit during an operating sequence and at a viewing point in time. The computing unit takes the interaction of the driver with the vehicle into consideration for ascertaining the viewing probability. The warning is issued as a function of the ascertained viewing probability.

9 Claims, 2 Drawing Sheets

(56) References Cited

U.S. PATENT DOCUMENTS

| | | | | |
|---|---|---|---|---|
| 2002/0198632 | A1* | 12/2002 | Breed et al. | 701/1 |
| 2003/0153846 | A1 | 8/2003 | Marple-Horvat | |
| 2005/0060069 | A1* | 3/2005 | Breed et al. | 701/29 |
| 2005/0125121 | A1* | 6/2005 | Isaji et al. | 701/36 |
| 2005/0134440 | A1* | 6/2005 | Breed | 340/435 |
| 2006/0250297 | A1* | 11/2006 | Prakah-Asante et al. | 342/70 |
| 2010/0117814 | A1 | 5/2010 | Lermer et al. | |
| 2010/0198491 | A1* | 8/2010 | Mays | 701/124 |
| 2011/0015818 | A1* | 1/2011 | Breuer et al. | 701/29 |

OTHER PUBLICATIONS

International Search Report dated Dec. 21, 2012 w/ English translation (six (6) pages).

* cited by examiner

VEHICLE HAVING A DEVICE FOR INFLUENCING THE ATTENTIVENESS OF THE DRIVER AND FOR DETERMINING THE VIEWING DIRECTION OF THE DRIVER

CROSS REFERENCE TO RELATED APPLICATIONS

This application is a continuation of PCT International Application No. PCT/EP2012/068821, filed Sep. 25, 2012, which claims priority under 35 U.S.C. §119 from German Patent Application No. 10 2011 083 833.3, filed Sep. 30, 2011, the entire disclosures of which are herein expressly incorporated by reference.

BACKGROUND AND SUMMARY OF THE INVENTION

The invention relates to a device for influencing the attention of the driver, wherein the vehicle comprises a display unit for displaying information content, the vehicle includes a central operating panel associated with the display unit, and the vehicle has a means for detecting a danger in road traffic and a means for issuing a warning regarding a detected danger.

Modern vehicles increasingly comprise numerous display and operating options. Information content is displayed via a central display unit, which is frequently located essentially at the center of the instrument panel and may slightly face the driver. This content may be technical information, navigation instructions or entertainment content.

Functions that the vehicle makes available to the user can be selected by way of a central operating panel, which is frequently placed essentially in the center console and potentially in the vicinity of the gearshift lever. An operating input at the central operating panel can be made by turning or pushing an operating switch or by touching an interface, such as a touch pad. An operating input can be visually tracked on the display unit by a change of the display of the output system which is associated with the operating input.

The operation of the operating panel is designed to be intuitive and easy-to-understand in modern vehicles so as not to compromise the attention of the driver and so as not to distract the driver from traffic. Moreover, driver assistance systems may focus the driver's eyes on traffic, in particular in the case of imminent danger. For this purpose, the driver assistance system ascertains a danger in traffic and issues a warning in a suitable manner in the event of an imminent dangerous traffic situation. This may be done visually, acoustically and/or haptically.

A warning is particularly useful when the driver's degree of attention can be optimized in time before the occurrence of a dangerous situation when the driver faces imminent danger and when the operating panel is being operated, involving a potential diversion of the driver's eyes to the display unit.

A warning system is described in DE 10 2008 056 343 A1, which cognitively considers operating actions that command the driver's attention.

It is an object of the invention to provide an alternative vehicle comprising a device for influencing the attention of the driver.

This and other objects are achieved by a vehicle, in particular a motor vehicle, having a device for influencing the attention of the driver. The vehicle includes a display unit for displaying information content; a central operating panel associated with the display unit; a system for detecting a danger in traffic; and a system for issuing a warning regarding a detected danger. According to the invention, a computing unit is provided, which ascertains the probability of a driver looking in the direction of the display unit during an operating sequence and at a viewing point in time, and which takes the interaction of the driver with the vehicle into account for ascertaining the viewing probability. Moreover, the warning is issued as a function of the ascertained viewing probability.

An operating sequence involves a (chronological) succession of operating inputs on the central operating panel. The viewing probability shall be understood to mean the probability that the driver's eyes are directed at the display unit in a targeted manner. The advantage of the invention is that a look by the driver at the display unit can be ascertained with a certain degree of accuracy, without using a camera system that detects the driver and has downstream image processing and complex image detection methods.

According to a particularly preferred embodiment of the present invention, the computing unit carries out a pattern detection algorithm for ascertaining the viewing probability and, in carrying out the pattern detection algorithm, takes a value of at least one input parameter into consideration, issues a value of the viewing probability as an output parameter, and transmits the viewing probability value to the system for issuing a warning. The viewing probability value indicates the probability with which the driver's eyes are directed at the display unit at the viewing point in time.

If a high viewing probability value is transmitted to the system for issuing a warning, which hereafter is referred to as a warning system, and the vehicle at this point in time, which is to say the viewing point in time, detects or has already detected an imminent danger in road traffic (such as a slow preceding vehicle), the warning system can issue an acoustic, visual and/or haptic warning.

A probability table, which correlates a value of the input parameter with a viewing probability value, is preferably stored in the computing unit for the at least one input parameter. This probability table of the at least one input parameter is taken into consideration by the computing unit when carrying out the pattern detection algorithm.

A probability table may be stored in the computing unit, which can be designed as a control unit. The correlation between a value of the input parameter and a viewing probability value can be ascertained during development of the vehicle. For this purpose, for example, experiments can be carried out with test subjects using driving simulators in which the line of sight of the test subject can be continuously detected. The quality of the correlation is dependent in particular on the number of test subjects.

According to a further variant, the vehicle includes a measuring device for measuring the accelerator pedal position, such as that of a gas pedal. According to this variant, the measuring device transmits the measured position of the pedal as a function of time to the computing unit. The computing unit further calculates a pedal gradient, which describes the change of the pedal position over time, and takes the pedal gradient into consideration as an input parameter when carrying out the pattern detection algorithm.

In particular, the accelerator pedal gradient can be a particularly suitable input parameter for the pattern detection algorithm, wherein the particular suitability of the parameter is defined by a strong correlation with the line of sight of the driver. For example, a high pedal gradient at the viewing point in time indicates a high degree of interaction by the driver with the pedal system of the vehicle. In this case, the probability is high that the driver's eyes are not directed at the display unit.

According to a preferred embodiment of the present invention, the vehicle includes a measuring device for measuring the brake pedal position. The measuring device transmits the measured position of the brake pedal as a function of time to the computing unit, the computing unit calculates a brake pedal gradient, which describes the change of the brake pedal position over time, and the computing unit takes the brake pedal gradient into consideration as an input parameter when carrying out the pattern detection algorithm.

In particular, the brake pedal gradient can be a particularly suitable input parameter for the pattern detection algorithm, wherein the particular suitability of the parameter is defined by a strong correlation with the line of sight of the driver. For example, a high brake pedal gradient at the viewing point in time indicates a high degree of interaction by the driver with the pedal system of the vehicle. In this case, the probability is high that the driver's eyes are focused on road traffic and are not directed at the display unit.

According to a preferred embodiment of the present invention, the vehicle includes a measuring device for measuring the steering angle, wherein the measuring device transmits the measured steering angle as a function of the time to the computing unit. Based on the steering angle-time curve, the computing unit calculates a steering angle number, which describes the number of steering angle inflection points in a predefined time period. Moreover, the computing unit takes the steering angle number into consideration as an input parameter when carrying out the pattern detection algorithm.

In particular, the steering angle number can be a suitable input parameter for the pattern detection algorithm, wherein the particular suitability of the parameter is defined by a strong correlation with the line of sight of the driver. For example, a high steering angle number at the viewing point in time indicates high steering activity by the driver. In this case, the probability is high that the driver's eyes are not directed at the display unit.

It may also be advantageous for the operating panel to include a rotation input mechanism if the operating panel measures a rotation pause duration, which describes the time period between the most recent rotary operating input and the viewing point in time, and for the operating panel to transmit the rotation pause duration to the computing unit. When carrying out the pattern detection algorithm, the computing unit takes the rotation pause duration into consideration as an input parameter.

The rotation pause duration can be a particularly suitable input parameter for the pattern detection algorithm, wherein the suitability of the parameter is defined by a strong correlation with the line of sight of the driver. For example, a short rotation pause duration at the viewing point in time, which is equivalent to a high frequency of operating inputs, allows the conclusion that the viewing point in time is within an operating sequence and that the probability is high that the driver's eyes are directed at the display unit.

According to a further variant of the present invention, the operating panel includes a push input mechanism, wherein the operating panel measures a push pause duration, which describes the time period between the most recent push operating input and the viewing point in time. The operating panel transmits the push pause duration to the computing unit. When carrying out the pattern detection algorithm, the computing unit takes the push pause duration into consideration as an input parameter.

The rotation pause duration can be a particularly suitable input parameter for the pattern detection algorithm, wherein the suitability of the parameter is defined by a strong correlation with the line of sight of the driver. A short push pause duration at the viewing point in time indicates that the viewing point in time is within an operating sequence and that the probability is high that the driver's eyes are directed at the display unit.

It may additionally be advantageous for the operating panel to include a touch input mechanism and for the operating panel to measure a touch pause duration. This describes the time period between the most recent touch operating input and the viewing point in time. The operating panel transmits the touch pause duration to the computing unit, and the computing unit takes the touch pause duration into consideration as an input parameter when carrying out the pattern detection algorithm.

In particular, the touch pause duration can be a suitable input parameter for the pattern detection algorithm, wherein the suitability of the parameter is defined by a strong correlation with the line of sight of the driver. A short touch pause duration at the viewing point in time, for example, indicates that the viewing point in time is within an operating sequence. In this case, the probability is high that the driver's eyes are directed at the display unit.

The invention is based on the following considerations. A vehicle can include a central display unit and a central operating element. Information can be provided to the driver via the central display unit. The vehicle additionally makes various functions such as navigation or entertainment available to a user, which functions can be operated by way of the central operating panel as the input system. Individual operating inputs can be visually tracked on the display unit by a change of the display of the output system which is associated with the operating input.

An operating input on the central operating panel can be made by turning or pushing an operating switch or by touching operating switch elements. If the operation is made by the driver of the vehicle, the operation may at least partially demand the driver's attention. The operation of the central operating panel is referred to as a secondary task, and the activities that are required by the driver for driving the vehicle, such as steering movements, shifting processes and pedal operation are referred as primary tasks.

As part of a warning strategy, existing driver assistance systems take dangers from the immediate surroundings of the vehicle, such as pedestrians or slow preceding vehicles, into consideration. The viewing angle of the driver is not included in this consideration. In particular, it is not detected whether the driver has his eyes focused on the road or on the dangerous situation at the time that the vehicle detected an imminent dangerous situation.

In terms of the type of warning signal (visual signal, acoustic signal, haptic signal), the intensity (volume, brightness, frequency) and the warning period, which is to say at what time interval does the warning occur in relation to the time that the vehicle enters the danger zone, a warning signal that is directed to the driver is made independent of the driver's viewing angle so as to assist the driver with focusing the driver's maximum attention on the primary task.

It is therefore proposed to estimate the direction of the driver's eyes in relation to the display unit based on operating inputs on the central operating panel and based on the interactivity of the driver with the vehicle. In the case of an estimation that results in a high probability that the eyes are directed at the display unit, properties of the warning signal are adjusted accordingly. The estimation does not require a camera system that is integrated into the vehicle and is based on a pattern detection algorithm.

Other objects, advantages and novel features of the present invention will become apparent from the following detailed description of one or more preferred embodiments when considered in conjunction with the accompanying drawing.

DETAILED DESCRIPTION OF THE DRAWING

Figure 1:
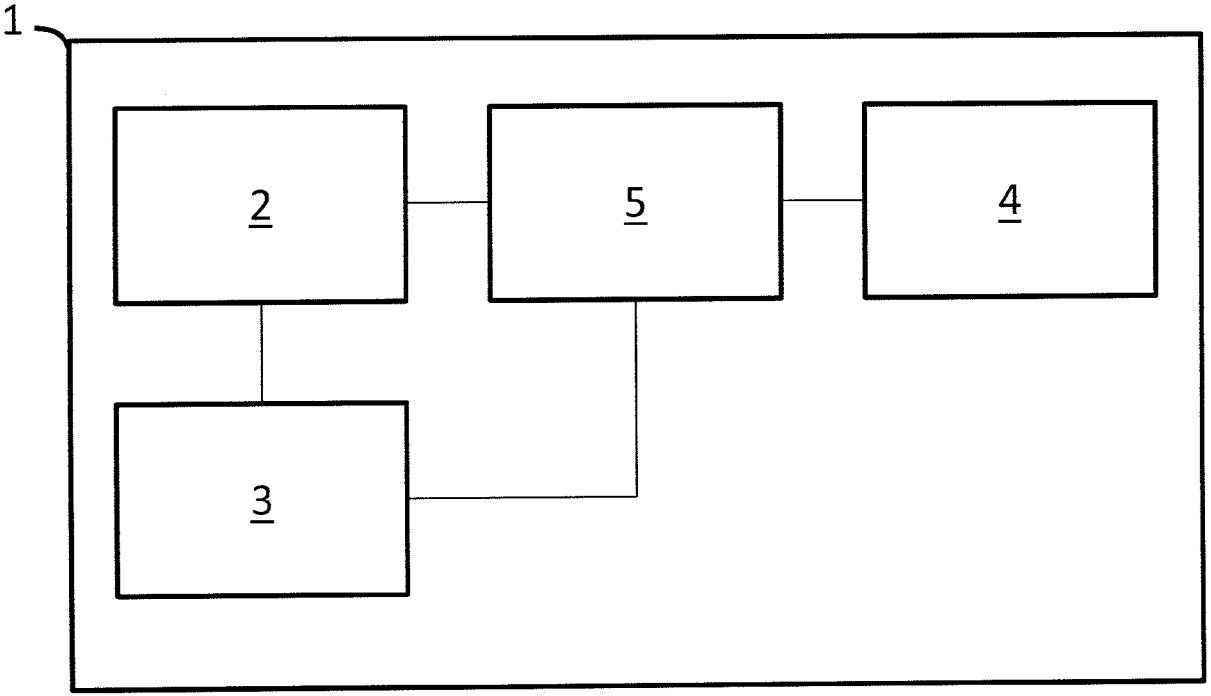
FIG. 1 depicts an exemplary vehicle and related components configured to implement the principles of the invention.

With reference to FIG. 1, a vehicle 1 has a central display unit 2, which in particular provides information to the driver of the vehicle 1. This information relates to navigation or entertainment functions, for example, and the representation is essentially visual. The vehicle 1 further has a central operating element (not shown), which makes various functions available to the user. The functions are operated via the central operating panel 3 as the input system. An individual operating input can be visually tracked on the display unit 2 by a change of the display of the output system which is associated with the operating input. Intuitive operability of the operating panel 3 is provided so as not to disadvantageously compromise the driver's attention during a chronological succession of operating inputs forming an operating sequence. The intuitive operability is supported by haptic feedback of the operating panel 3, such as in the form of detent positions during a rotational movement.

The vehicle 1 is additionally equipped with an assistance system that detects dangers and/or potential dangers in a traffic situation (hazard detection system 4). According to a warning strategy of the assistant system, the driver is alerted by a suitable warning signal. The type of the warning signal (visual and/or acoustic and/or haptic), the intensity of the warning signal (such as volume in the case of an acoustic signal) and the point in time when the warning signal starts prior to the imminent danger may be an integral part of the warning strategy.

The viewing angle of the driver at the time that the hazard detection system 4 detects the danger is an important input variable for the warning strategy. For example, a warning regarding a danger must take place sooner and/or in a clearly more perceptible manner when a driver's eyes are directed away from the roadway than when the eyes are entirely directed at the roadway.

Based on the driver's interaction with the vehicle 1, it can be estimated according to this exemplary embodiment whether there is a high probability that the driver's eyes are directed at the display unit 2. If the driver's eyes are directed at the display unit 2, the driver's eyes are directed at least only to a limited extent at the roadway at this point in time. If, at this point in time, the hazard detection system 4 detects a danger, or if a danger that is still present was detected at an earlier point in time, the warning strategy suitably adjusts the warning signal. For example, the warning may start at an earlier point in time.

A pattern detection algorithm is used to detect when the driver is looking at the display unit 2. The vehicle includes a computing unit 5 to carry out the pattern detection algorithm.

The pattern detection algorithm comprises multiple input parameters, which are transmitted to the computing unit 5.

One parameter, for example, is the rotation pause duration of the operating panel if the operating panel 3 allows operating inputs by rotating a switching element or a switching unit. The operating panel 3 measures the rotation pause duration as the time period between the last rotation input on the operating panel 3 and a reference point in time at which the value of the rotation pause duration is ascertained by the operating panel 3 and transmitted to the computing unit 5 for initializing and carrying out the algorithm.

A small value of the parameter 'rotation pause duration' at the reference point in time means that a rotation input was made a short time before the reference point in time. In this way, there is at least a certain probability that the driver's eyes are linked to the operation of the operating panel 3 made just a short time before and are consequently directed at the display unit 2.

At the same reference point in time, the operating panel 3 detects a push pause duration in a corresponding manner and transmits the same if the operating panel 3 includes operating inputs by pushing a switching element or a switching unit.

A touch pause duration ascertained in an analogous fashion is also transmitted to the computing unit 5 if the operating panel 3 allows operating inputs by touching sensitive surfaces such as those of a touch pad, for example.

The steering angle can be measured in a time-resolved manner by the steering unit of the vehicle and can be transmitted to the computing unit 5. The progression of the steering angle in a predefined time window ending at the reference point in time is used by the computing unit 5 to calculate the number of inflection points of the steering angle in the time window. This steering angle number serves as an input parameter for the pattern detection algorithm. A high steering angle number is equivalent to frequent steering maneuvers and, with high probability, correlates with a high degree of attention to traffic by the driver and, to a lesser degree with the driver's attention to the display on the display unit 2.

Another input parameter for the pattern detection algorithm is the accelerator pedal gradient at the reference point in time. The position of the pedal (such as a gas pedal angle) can be ascertained in a time-resolved manner by a suitable measuring device in the vehicle. The progression of the pedal position in a predefined time window ending at the reference point in time is transmitted to the computing unit 5. The computing unit 5 calculates the number of pedal strokes in this time window, which is to say the number of inflection points of the pedal angle. This number can be referred to as the pedal stroke number. A high pedal stroke number is equivalent to a high degree of an interaction by the driver with the pedal system of the vehicle. The probability that the driver's eyes are directed at the display unit 2 is low in this case.

As an alternative or in addition, the computing unit 5 may ascertain a pedal gradient at the reference point in time. The pedal stroke number and/or the pedal gradient serve as input parameters for the pattern detection algorithm.

A brake pedal stroke number and/or a brake pedal gradient can be ascertained by the computing unit 5 in a corresponding fashion. A prerequisite is that the measured chronological progression of the brake pedal position is transmitted to the computing unit 5. A high brake pedal gradient indicates strong braking intervention at the reference point in time. It may therefore be assumed with high probability that at this moment, this being the reference point in time, the driver's eyes are not directed at the display unit 2. The brake pedal stroke number and/or the brake pedal gradient serve as input parameters for the pattern detection algorithm.

The pattern detection algorithm ascertains the viewing probability with which the driver is looking at the display unit 2 at the reference point in time. The algorithm outputs a viewing probability value between 0% and 100%, or 0 and 1. The input parameters for the algorithm are described above. The algorithm can be carried out at any arbitrary reference points in time, such as at regular intervals or at the point in time when a danger is detected by the hazard detection system. This moment may then serve as the reference point in time of the algorithm. The viewing probability value output by the algorithm is transmitted from the computing unit 5 to the hazard detection system 4 and serves as an input value for the warning strategy of the hazard detection system 4.

The pattern detection algorithm can be based on various pattern detection algorithms. One exemplary method for ascertaining the conditional dependencies between variables (here, between the viewing probability and the input parameters) is a Bayesian network. An algorithm according to the principle of neural networks, fuzzy logic or apriori rules may also be considered. Without limiting the general nature, a Bayesian network shall be assumed hereafter.

The Bayesian network is trained based on driving simulator data, for example. To train the network, essentially all operating inputs into the operating panel 3 of the driving simulator as well as the driver's view are chronologically recorded by way of a camera system in the driving simulator. This information can be used to ascertain probability tables for each input parameter according to the maximum likelihood method, which correlate the probability that the driver is looking at the display unit 2 in the driving simulator with a value of the corresponding input parameter. The look at the display unit 2 is also referred to as the display view. Every probability table forms a node in the Bayesian network. This data basis is used to train and test the Bayesian network in vehicle development. This trained Bayesian network is implemented on the computing unit 5 and can be executed on the computing unit 5.

Carrying out the Bayesian network algorithm includes the ascertainment of the viewing probability value based on the values of the input parameters at the reference point in time according to Equation 1:

$$P(\text{display view})=P(\text{view})\cdot P(\text{view}|\text{rotation pause duration})\cdot P(\text{view}|\text{push pause duration})\cdot P(\text{view}|\text{gas pedal gradient})\cdot P(\text{view}|\text{brake pedal gradient})\cdot P(\text{view}|\text{steering angle number}),$$

where P(display view) corresponds to the probability that the driver's eyes are directed at the display unit 2 (viewing probability value). In Equation 1, for example, the factor P(view|rotation pause duration) denotes a node probability value in the Bayesian network, which indicates the probability that the driver's eyes are directed at the display unit 2 at a particular value of the rotation pause duration. This is apparent from the probability table for the rotation pause duration. For example, if the rotation pause duration ranges between 0.29 seconds and 0.35 seconds, the conditional node probability P(view|0.29-0.35) has the value 0.043. The factor P(view) represents the probability that the driver's eyes are directed at the display unit 2, independently of the parameters "rotation pause duration", "push pause duration", "pedal gradient", "brake pedal gradient" and "steering angle number."

The Bayesian network may also include branched nodes. In this case, multi-dimensional probability tables are stored, wherein an additional branch corresponds to an additional dimension in the table.

For example, an interaction sequence by the driver may be taken into consideration in a branched structure. This means that the algorithm takes the sequence of driver interactions with the vehicle during a predefined time period before the reference point in time into consideration when ascertaining the viewing probability value based on the trained data. If, for example, a steering angle deflection took place in the time period chronologically before a push operating input as the two most recent interaction inputs, the algorithm ascertains a different viewing probability than in the reverse case, which is to say when a steering angle deflection as the most recent interaction follows a push operating input.

The meaningfulness of the algorithm on the viewing probability ascertainment (view estimation) may be further increased when behavioral patterns of a driver during the interaction with the vehicle are also taken into consideration when the algorithm is carried out. For example, using the sequence of operating inputs, which is to say an operating sequence, it is possible to derive how quickly an operating task (such as input of a navigation destination) is completed. With the aid of a driving simulator and with the support of a plurality of test subjects in vehicle development, for example, it can be ascertained whether an operating task is completed quickly or slowly, for example, or directly in a menu tree or indirectly using menu navigation. If the test subject's eyes are recorded during the operating task using a camera system, the recorded data may be used to expand and train the algorithm to the effect that the algorithm assigns the operator to a group of operators or to an operating class. An operator can then be associated with an operating group with a certain probability based on the trained algorithm without a camera system in the vehicle, and only based on the features of an operating sequence in the vehicle. For example, a "blind operator" typically selects a direct path in the menu tree, while a control operator tends to correct inputs several times. Based on the test subject data, it is known that a "blind operator" completes an operating sequence almost without looking at the display unit 2. A "control operator", in contrast, will look at the display unit 2 several times during the operating sequence. The information about the association of the driver, who may be recognized by the vehicle key, by a voice input system or by a fingerprint input system, for example, can likewise be taken into consideration in the further execution of the Bayesian network algorithm as a node, which is to say as an input parameter having an associated probability table, or as a weighting factor, for example.

The exemplary embodiment shows how a probability that the driver is looking at the display unit 2 at a particular point in time can be indicated using a pattern detection algorithm that is trained in vehicle development, without the use of a camera system recording the driver. This probability can be used to adjust the warning strategy of a hazard detection system 4 located in the vehicle.

In this way, a cost-effective improvement measure for a hazard detection system 4 can be implemented. The proposed solution is a production vehicle having no integrated hardware, in particular having no integrated passenger compartment camera system, for example if the algorithm can be carried out on an existing control unit and the vehicle already has the measuring devices (that are common and used elsewhere in the vehicle) for the input parameters. In particular in high-volume production, the development costs can thus be more than compensated for by a driving simulator simulating the plurality of production vehicles.

The algorithm for detecting a behavioral pattern of the operator in terms of the operating and display unit 2 of the vehicle 1, which expands and supplements the algorithm for estimating the viewing direction, is described in more detail hereafter:

A vehicle can include a central display unit and a central operating element. Information can be provided to the driver via the central display unit. The vehicle additionally makes various functions, such as navigation or entertainment functions, available to a user, which can be operated by way of the central operating panel as the input system. Individual operating inputs can be visually tracked on the display unit by a change of the display of the output system which is associated with the operating input.

An operating input on the central operating panel can be made by turning or pushing an operating switch or by touching operating switch elements. If the operation is made by the driver of the vehicle, the operation at least partially demands the driver's attention. The operation of the central operating panel is referred to as a secondary task, and the activities that are required by the driver for driving the vehicle, such as steering movements, shifting processes and pedal operation, are referred as primary tasks.

As part of a warning strategy, existing driver assistance systems take dangers from the immediate surroundings of the vehicle into consideration, such as pedestrians or slow preceding vehicles. The driver's state of attention is not included in this consideration. In particular, it is not detected whether the driver visually recognizes the imminent dangerous situation or is perhaps visually distracted, such as due to the operation of vehicle functions. In terms of the type of the warning signal (visual signal, acoustic signal, haptic signal), the intensity (volume, brightness, frequency) and the warning point in time, which is to say at what time interval does the warning occur in relation to the time that the vehicle enters the danger zone, a warning signal that is directed to the driver is made independent of the driver's state of attention so as to assist the driver in directing the full attention at the primary task.

Particular advantages therefore exist if the driver's attention can be estimated based on operating inputs on the central operating panel and based on the driving behavior or a driving situation. In the case of a dangerous situation, the properties of the warning signal are adjusted to the drivers' estimated attention.

The vehicle detects an operating mode of the driver in terms of the operation of the central operating panel, associates a driver's degree of distraction with the driver's operating mode, and issues the warning as a function of the degree of distraction.

Based on the manner in which the driver operates the central operating panel, it can be ascertained with high probability, and without the use of a camera system, to what degree the driver's eyes are directed at the display unit and averted from traffic. If the degree of distraction is high, a warning signal may be displayed already at a particularly early point in time, for example.

The vehicle further includes a control unit or an computing unit, which can measure the time period between two operating inputs of an operating sequence. The time period between two operating inputs is referred to hereafter as an operating pause.

An operating sequence involves a succession of operating inputs on the central operating panel. If the degree of distraction is high, the eyes of the operator of the operating panel may be directed away from traffic frequently and for long periods during the succession of operating inputs. If the degree of distraction is low, the eyes of the operator of the operating panel are usually directed at the road during the succession of operating inputs.

The control unit can calculate a mean operating pause for detecting the operating mode. In addition, a predefined characteristic curve is stored in the control unit, the curve correlating the degree of distraction with the mean operating pause so that the control unit, based on the characteristic curve, can associate a value for the degree of distraction with the value of the mean operating pause.

A relationship between the mean operating pause and the degree of distraction, which is ascertained during vehicle development, can be stored in the control unit or the computing unit. The association is made based on the value of the mean operating pause. This offers the advantage that a degree of distraction of the driver can be ascertained solely by the operating panel and the control unit. This ensures a cost-effective and simple solution for ascertaining the driver's degree of distraction, which does not require a complex camera system having automatic field of view detection. Since common display and operating panels for vehicles already include a control unit anyhow, the solution according to the invention is very robust, since it involves only low complexity for integrating software and hardware into the vehicle.

The warning may be issued earlier and/or the warning can be done so as to be better noticed by the driver in the case of a high value of the degree of distraction. This offers the advantage that a driver who is distracted from traffic can be alerted of a danger earlier and more clearly, and can thus direct his attention back at traffic more effectively.

A first operating input defines the start of an operating sequence. An operating sequence ends when a pedal intervention or a steering intervention or an operating interruption is made.

If an operating sequence ends by a pedal intervention, it is particularly advantageous when a pedal intervention involves a change of the accelerator pedal position or of the brake pedal position over time, when the change of the pedal position over time exceeds a pedal intervention limit, or when the change of the brake pedal position over time exceeds a brake pedal intervention limit.

The accelerator pedal intervention limit and the brake pedal intervention limit can be stored in the control unit or the computing unit. If a strong change of a pedal position takes place in a short time such that the respective intervention limit is exceeded, the operating sequence ends. It can then be assumed that a traffic situation demanding the driver's full attention (such as full brake application) has occurred, and that a sequence of operating inputs is interrupted temporarily at least until the operating input is continued. The continuation of the operating input constitutes a new operating sequence.

If an operating sequence ends by a steering intervention, a steering intervention involves a change of the steering angle over time, wherein the change of the steering angle over time exceeds a steering angle intervention limit.

The steering angle intervention limit can be stored in the control unit or the computing unit. If a strong change of the steering angle takes place in a short time such that the steering angle intervention limit is exceeded, an operating sequence ends. It can then be assumed that a traffic situation demanding the driver's full attention (such as sharp turn) has occurred, and that a sequence of operating inputs is interrupted temporarily at least until the operating input is continued. The continuation of the operating input constitutes a new operating sequence.

It is also advantageous if an operation interruption of an operating input occurs which is followed by an operating pause that drops below an interruption threshold value.

The interruption threshold value can be stored in the control unit. If over a time period that is greater than the interruption threshold value, it can be assumed that the user has ended the succession of operating inputs. This occurs, for example, when the user has successfully set a certain function, such as a different radio station. It is also possible to store a threshold value that indicates a minimum duration for an operating pause in the control unit. Only if an operating pause exceeds this value does this contribute to the mean value creation. This is particularly advantageous with rotary switches or switches having a scroll function. It can then be prevented that indiscriminate scrolling or turning of the switch is detected, which occurs in particular when a driver "plays" with the operating panel and less when a function is to be set in a targeted manner.

Finally, the vehicle associates the driver with an operating type class in terms of the operating mode of the central operating panel, wherein the vehicle has several operating type classes he can be associated with. The warning is made as a function of the operating type class with which the driver is associated.

This discontinuous association of the degree of distraction is particularly useful when the correlation between the degree of distraction and the mean operating pause, as obtained in vehicle development, exhibits such a high standard deviation that the continuous association of the degree of distraction constitutes spurious accuracy.

An operating pause is calculated according to the time period between two operating inputs on the central operating panel within an operating sequence. An operating sequence is defined by a succession of operating inputs on the central operating panel and starts with a first operating input. The operating pauses are detected by the control unit and stored at least temporarily.

As soon as a predefined number of operating pauses has been detected by the control unit or the computing unit, a mean value of the operating pauses is created, which is referred to as the mean operating pause. The control unit associates a value of the degree of distraction with the ascertained value of the mean operating pause according to the look-up table.

Figure 2:
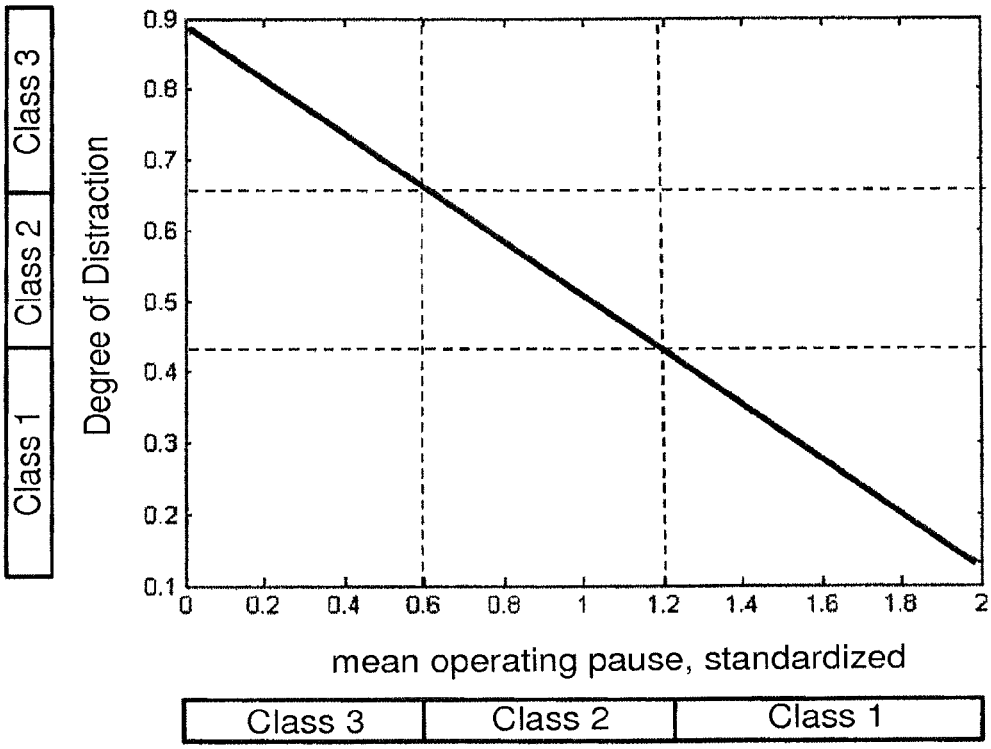
FIG. 2 is a graph showing a relationship between a unit-less degree of distraction on the y axis and a mean operating pause of a central operating panel on the x axis, wherein the correlation according to FIG. 2 is stored in a control unit or a computing unit of the vehicle as a look-up characteristic.

Based on an operating sequence, the degree of distraction (AM) according to the y axis of FIG. 2 is described as:

$$AM\ [\%] = \frac{\sum \text{Duration of look at display unit [sec]}}{\sum \text{Duration of look at display unit [sec]} + \sum \text{Duration of look at traffic [sec]}}$$

With respect to a predefined operating task, which can be completed in a succession of operating inputs in the form of an operating sequence, the degree of distraction indicates the degree at which the driver directs his eyes at the display unit while driving. Frequent looking at the display unit denotes a high degree of distraction from traffic. This correlates with a lacking degree of attention.

Based on test subjects in a driving simulator in vehicle development, including detection of the driver's eyes, the relationship between the degree of distraction and the mean operating pause shown in FIG. 2 can be ascertained. It is apparent based on a significant trend that an operating sequence having longer time intervals between two operating inputs correlates with a low degree of distraction. If the test subject wants to go through the operating sequence as quickly as possible and complete the operating task in a short period of time, this requires a high degree of attention at the expense of the driver registering the traffic situation. The progression according to FIG. 2 ascertained in vehicle development with statistical relevance can be stored in the customer vehicle as a look-up characteristic.

In addition, there is the option to perform the association between the mean operating pause of the operating sequence and the degree of distraction discontinuously. For this purpose, three groups of operating classes are shown in FIG. 2. Class 1 shows users who essentially direct their eyes on the road during the operating task. The haptic feedback from the switch or the interfaces or operating buttons is sufficient for a user of class 1 to complete the operating task. A user of class 1 is characterized by high operating confidence and can be referred to as a "blind operator." With a "normal operator" of class 2, the ratio between the viewing duration of the display unit and of traffic is approximately balanced. A user of class 3, who can be referred to as a "control operator", is distracted during the operation of the central operating panel by frequent and long control looks at the display unit.

The value of the degree of attention can be ascertained based on an operating sequence. In the case of multiple operating sequences during a trip, a mean degree of attention can be ascertained for the driver, wherein multiple values of the degree of attention are averaged by the control unit.

If a driver can be identified by the vehicle having driver detection—such as by fingerprint detection, by a camera system in the vehicle or by a key associated with the driver—a degree of distraction can be individually ascertained by the control unit for a driver over multiple trips. In this way, the fact that the user becomes more familiar with handling the display and operating panel as a result of a learning effect can be reflected in the value of the degree of distraction, so that a lower degree of distraction may be attained. A value for the degree of distraction that is ascertained over a plurality of trips and operating sequences can potentially also be stored in the control unit for the respective detected driver, without having to re-ascertain the value of the degree of distraction during a later trip.

The value of the degree of attention serves as an input parameter for the warning system of the vehicle. If the value of the driver's degree of attention is low, the warning signal is, or the warning signals are, more pronounced for an imminent danger as compared to a higher value of the degree of attention. The volume of an audio warning is increased, the light intensity of a warning lamp or the flashing frequency of a warning light device is increased. In addition, the vibration amplitude of the steering wheel can be increased, as is known from the prior art for lane change assist systems. In addition, it is possible to trigger the warning at an earlier time before the vehicle reaches the dangerous area. An earlier warning can be combined with a more pronounced warning. This can also be done continuously, wherein the warning intensity can be increased as the dangerous situation comes closer.

If the vehicle includes a camera system detecting the driver, the viewing angle of the driver can additionally be detected. The warning strategy can then be adapted not only to the operating class of the driver, but to a combination of the detected viewing angle of the driver with an imminent danger and the operating class. For example, if a "control operator" has directed the eyes at the display unit at the moment that the vehicle detects the danger, the warning must be indicated earlier than for a "blind operator" since the probability is higher for the second operator that the eyes are directed back at the road in time and without warning.

The information about the associated operating class can be transmitted to the algorithm for calculating the viewing probability value. As an alternative, the algorithm for associating the driver with an operating class can also be part of the algorithm for calculating the viewing probability value. The information about an operating class is taken into consideration in a suitable fashion when the pattern detection algorithm for calculating the viewing probability value is carried out.

For example, if the pattern detection algorithm is an apriori model that is learned for the series in vehicle development and that is based on dependency rules between the driver looking at the display unit and a value of an input parameter, the information about the operating class can be used to adjust threshold values. A possible apriori rule may be: if a rotation pause duration drops below a threshold value, the driver's eyes are directed at the display unit. This threshold value is associated with a lower time value for the information "blind operator" than for the information "control operator", for example.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A motor vehicle, comprising:

a display unit configured to display information content;

a central operating panel associated with the display unit;

a system configured to detect a danger in traffic and issue a warning regarding a detected danger;

a computing unit configured to:

ascertain a viewing probability of a driver of the motor vehicle looking in a direction of the display unit during an operating sequence and at a viewing point-in-time, in ascertaining the viewing probability, takes into consideration an interaction of the driver with the vehicle, and control the system to issue the warning as a function of the ascertained viewing probability.

2. The vehicle according to claim 1, wherein the computing unit further:

carries out a pattern detecting algorithm to ascertain the viewing probability, wherein in carrying out the pattern detection algorithm, takes a value of at least one input parameter into consideration, issues a value of the viewing probability as an output parameter, the viewing probability value indicating a probability with which the drivers eyes are directed at the display unit at the viewing point-in-time, and transmits the viewing probability value to said system.

3. The vehicle according to claim 2, wherein a probability table, which correlates the value of the input parameter with a viewing probability value, is stored in the computing unit for the input parameter; and the computing unit takes the probability table of the input parameter into consideration when carrying out the pattern detection algorithm.

4. The vehicle according to claim 2, further comprising:

a measuring device configured to measure an accelerator pedal position and transmit the measured pedal position to the computing unit as a function of time, wherein the computing unit calculates a pedal gradient describing a change of the pedal position over time, and the computing unit takes the pedal gradient into consideration as an input parameter when carrying out the pattern detection algorithm.

5. The vehicle according to claim 2, further comprising:

a measuring device configured to measure a brake pedal position and transmit the measured position to the computing unit as a function of time, wherein the computing unit calculates a brake pedal gradient describing a change of the brake pedal position over time, and the computing unit taking the brake pedal gradient into consideration as an input parameter when carrying out the pattern detection algorithm.

6. The vehicle according to claim 2, further comprising:

a measuring device configured to measure a steering angle and transmit the measured steering angle to the computing unit as a function of time, wherein the computing unit computes a steering angle number describing a number of steering angle inflection points in a predefined time period, and the computing unit takes the steering angle number into consideration as an input parameter when carrying out the pattern detection algorithm.

7. The vehicle according to claim 2, further comprising:

a rotation input mechanism of the central operating panel;

a measuring device configured to measure a rotation pause duration of the rotation input mechanism, the rotation pause duration describing a time period between a most recent rotary operation input of the rotation input mechanism and the viewing point-in-time, and transmit the rotation pause duration to the computing unit, wherein the computing unit takes the rotation pause duration into consideration as an input parameter when carrying out the pattern detection algorithm.

8. The vehicle according to claim 2, further comprising:

a push input mechanism of the central operating panel;

a measuring device configured to measure a push pause duration of the push input mechanism, the push pause duration describing a time period between a most recent push operating input of the push input mechanism and the viewing point-in-time, and transmit the push pause duration to the computing unit, wherein the computing unit takes the push pause duration into consideration as an input parameter when carrying out the pattern detection algorithm.

9. The vehicle according to claim 2, further comprising:

a touch input mechanism of the central operating panel;

a measuring device configured to measure a touch pause duration of the touch input mechanism, the touch pause duration describing a time period between a most recent touch operating input and the viewing point-in-time, and transmit the touch pause duration to the computing unit, wherein the computing unit takes the touch pause duration into consideration as an input parameter when carrying out the pattern detection algorithm.

* * * * *